US008081920B2

(12) United States Patent
Tanaka

(10) Patent No.: US 8,081,920 B2
(45) Date of Patent: Dec. 20, 2011

(54) TRANSFER MATERIAL SEPARATING DEVICE, TRANSFER DEVICE AND IMAGE FORMING APPARATUS

(75) Inventor: Shinichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 453 days.

(21) Appl. No.: 12/359,919

(22) Filed: Jan. 26, 2009

(65) Prior Publication Data

US 2009/0190979 A1 Jul. 30, 2009

(30) Foreign Application Priority Data

Jan. 28, 2008 (JP) ..... 2008-016083
Oct. 6, 2008 (JP) ..... 2008-259489

(51) Int. Cl.
*G03G 15/00* (2006.01)

(52) U.S. Cl. ..... 399/397; 399/381

(58) Field of Classification Search ..... 399/397
See application file for complete search history.

(56) References Cited

U.S. PATENT DOCUMENTS 3,545,746 A * 12/1970 Clayton et al. ..... 271/196
3,780,960 A * 12/1973 Tokuno et al. ..... 242/555.2
3,819,175 A * 6/1974 Borostyan et al. ..... 271/310
5,031,002 A 7/1991 Yaguchi
5,186,451 A * 2/1993 Hirao ..... 271/196
5,552,873 A * 9/1996 Hirao et al. ..... 399/315
5,608,511 A * 3/1997 Attridge ..... 399/398
6,026,276 A * 2/2000 Malachowski ..... 399/400
7,037,251 B2 * 5/2006 Stefanoni ..... 493/359

FOREIGN PATENT DOCUMENTS

EP 0313088 A2 4/1989
GB 1436393 A 5/1976
JP 55043514 A 3/1980
JP 57050081 A 3/1982
JP 60256171 A 12/1985
JP 2007197152 A 8/2007

OTHER PUBLICATIONS

European search report for corresponding European application 09001119.8.

* cited by examiner

*Primary Examiner* — Anthony Nguyen
(74) *Attorney, Agent, or Firm* — DLA Piper LLP (US)

(57) ABSTRACT

A transfer material separating device includes a transfer material moving member (intermediate transfer belt) adapted to move with a transfer material held in contact with and pressed against it so as to have a liquid developer image transferred onto the transfer material and a transfer material separation/suction section (a suction wheel, a suction wheel support lever, a cam and a spring) for sucking the transfer material moving with the transfer material moving member at the surface opposite to the image transfer surface thereof and separating the transfer material from the transfer material moving member.

5 Claims, 14 Drawing Sheets contacted state separated state

TRANSFER MATERIAL SEPARATING DEVICE, TRANSFER DEVICE AND IMAGE FORMING APPARATUS

CROSS REFERENCE TO RELATED APPLICATIONS

This application is based upon and claims the benefit of priority from prior Japanese Patent Application No. 2008-016083, filed Jan. 28, 2008, and Japanese Patent Application No. 2008-259489, filed Oct. 6, 2008, the entire contents of which are incorporated herein by reference.

BACKGROUND

1. Technical Field

The present invention relates to a transfer material separating device for separating a transfer material onto which a liquid developer image is transferred from a transfer material moving member in an image forming apparatus adapted to use liquid developer (toner) such as a copying machine, a facsimile machine, a printer or the like, a transfer device for transferring a liquid developer image onto a transfer material and an image forming apparatus.

2. Related Art

Generally, a liquid developer image is transferred onto a transfer material as the transfer material is brought into contact with and pressed against a transfer medium in a transfer device and moved with the transfer medium in an image forming apparatus that is designed to use liquid developer (liquid toner). Additionally, the liquid developer image is fixed as the transfer material onto which the liquid developer image is transferred is brought into contact with and pressed against a fixing member and moved with the fixing member in a fixing device.

With such an arrangement, more specifically, the transfer surface of the transfer material that is to carry the liquid developer image is brought into contact with and pressed against the transfer medium or the transfer material moving member such as the fixing member. As the transfer surface of the transfer material is pressed against the transfer material moving member, the transfer material is apt to adhere to the transfer material moving member because of the properties specific to the liquid developer. Then, it is difficult to separate the transfer material onto which the liquid developer image is transferred from the transfer material moving member. For this reason, JP3128067 (to be referred to as Document 1 hereinafter) proposes an image forming apparatus that includes a transfer material separating device by means of which the transfer material is forcibly separated from the transfer material moving member at the front edge thereof by blowing air toward the front edge of the transfer material moving with the transfer material moving member.

With the transfer material separating device described in the Document 1, blown air penetrate into between the front edge of the transfer material and the transfer material moving member to separate the front edge of the transfer material.

The transfer material separating device described in the above-cited Document 1 simply blows air toward the front edge of the transfer material during an image forming operation so that it is not easy to reliably separate the transfer material. Additionally, since air is blown toward the transfer surface side of the transfer material, the liquid developer image transferred on the transfer material can be adversely influenced by blown air.

SUMMARY

The object of the present invention is to provide a transfer material separating device, a transfer device and an image forming apparatus that can reliably separate a transfer material without exerting any adverse influence on the image transferred onto the transfer material.

According to the present invention, the above object is achieved by providing a transfer material separating device, a transfer device and an image forming apparatus adapted to suck the second surface of a transfer material that is opposite to the first surface of the transfer material by means of a transfer material separation/suction section. Thus, the transfer material can be reliably separated from the transfer material moving member, which is an image carrier such as a transfer medium or a latent image carrier, as it is held in contact and moving with the transfer material moving member because it is being sucked. Then, as a result, the transfer material is prevented from moving with the transfer material moving member and reliably moved toward the next conveyance site. Additionally, since the transfer material is sucked at the second surface thereof that is opposite to the first surface, which is the transfer surface, the image transferred onto the transfer material is prevented from being adversely influenced by suction.

Particularly, a suction member is adapted to be brought into contact with or separated from the transfer material moving member such that the suction member can be held in contact with the transfer material moving member only when the transfer material is being conveyed and separated from the transfer material moving member when the transfer material is not being conveyed. Therefore, any residual toner and foreign objects such as dust can be prevented from adhering to the suction member from the transfer material moving member. Thus, as a result, any possible smearing of the transfer material when it is being sucked can be effectively suppressed.

Still additionally, the suction member includes a suction port side member having a suction port that is arranged to face the transfer material being conveyed when the suction wheel outer ring of the suction member is brought into contact with the transfer material moving member. Besides, the suction wheel outer ring is provided with through holes. Thus, air is sucked in by way of the through holes of the suction wheel outer ring that are arranged vis-a-vis the suction ports. Therefore, the suction member can constantly suck the transfer material in a sucking operation regardless if the suction wheel outer ring is rotated as the transfer material and the transfer material moving member move. Additionally, since air is sucked through the small suction port that constantly faces the transfer material during the sucking operation and has a relatively small capacity, the transfer material sucking power can be effectively secured to such a level that the transfer material is reliably separated from the transfer material moving member. Then, the capacity of the sucking section can be reduced so much. Still additionally, since the transfer material is not sucked by the suction wheel outer ring once it is moved away from the suction port, the transfer material can be smoothly moved to the next conveyance site.

Furthermore, as the suction wheel outer ring rotates in a state where the vacuum wheel taking in air, the suction port side member rotates to a predetermined extent in the sense of rotation of the suction wheel outer ring. Then, as a result, the transfer material can be conveyed to the guide position for the transfer material belt conveyance device while reliably sucking the transfer material by means of the vacuum wheel. At this time, if the suction wheel outer ring is rotating, the suction port side member follows the rotation so that air can be reliably taken in by means of the suction wheel outer ring and the suction port side member. Therefore, the width of the suction port of the suction port side member in the peripheral direction can be small but effective. Thus, the pressure loss of the vacuum wheel can be suppressed when the transfer material is being sucked by the vacuum wheel. Then, as a result, the air suction device such as vacuum pump can be downsized to reduce the cost.

Finally, a cleaning member is provided and held in contact with the suction member so that the foreign objects adhering to the suction member can be removed by means of the cleaning member while the suction member is in operation. Then, as a result, the suction member can operate to stably suck transfer materials without smearing them for a long period of time.

BRIEF DESCRIPTION OF THE DRAWINGS

The invention will be described with reference to the accompanying drawings, wherein like numbers reference like elements.

DESCRIPTION OF THE EXEMPLARY EMBODIMENTS

Now, preferred embodiments of the present invention will be described by referring to the accompanying drawings.

Figure 1:
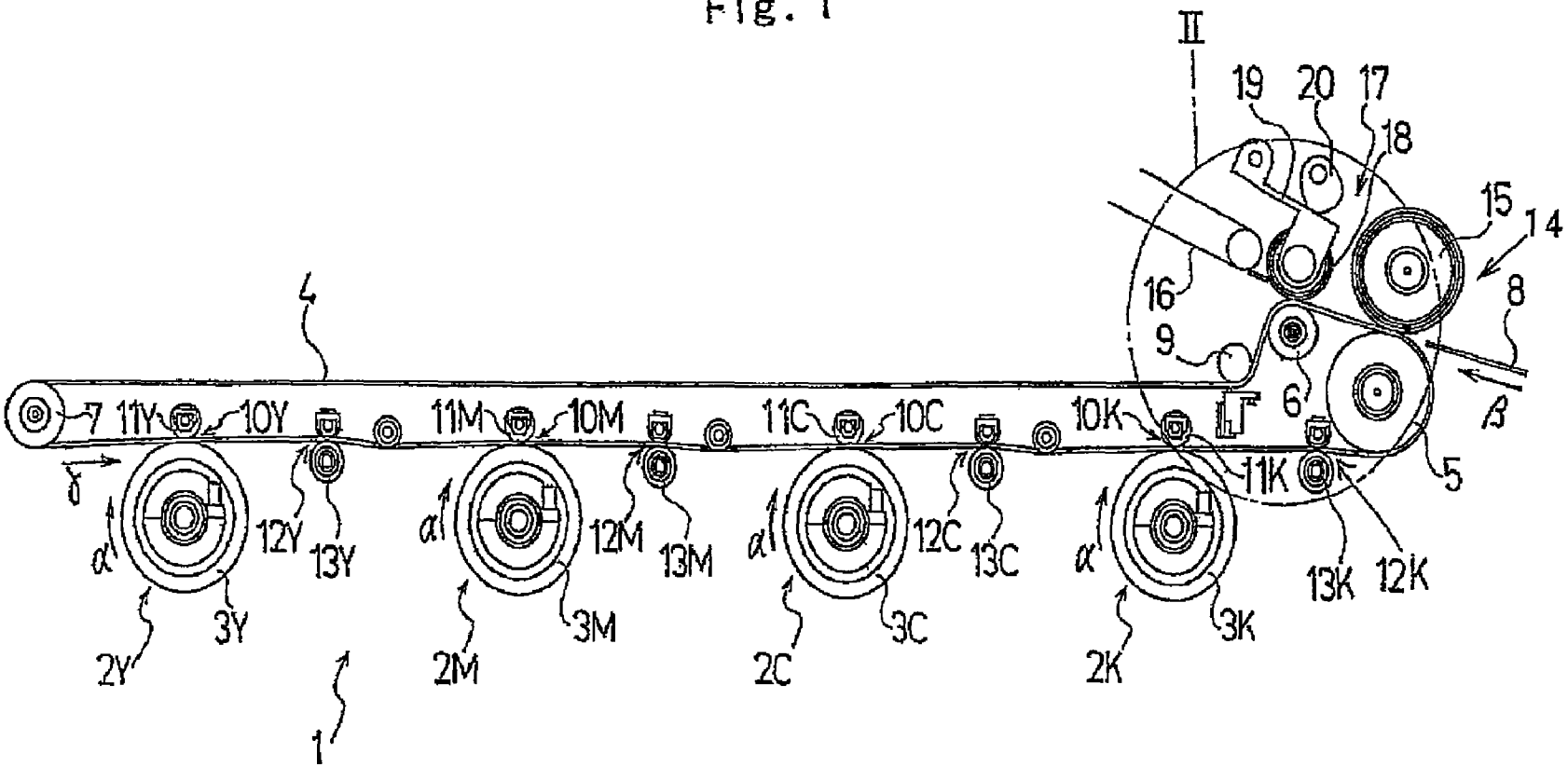
FIG. 1 is a schematic partial view of the first example of an embodiment of the image forming apparatus having a transfer material separating device according to the present invention.

FIG. 1 is a schematic partial view of the first example of an embodiment of the image forming apparatus having a transfer material separating device according to the present invention.

Referring to FIG. 1, the image forming apparatus 1 of the first example has image forming units 2Y, 2M, 2C and 2K that are arranged in tandem and adapted to image respectively by means of yellow (Y), magenta (M), cyan (C) and black (K) liquid developers. Of the image forming units 2Y, 2M, 2C and 2K, 2Y denotes the yellow image forming unit and 2M denotes the magenta image forming unit, while 2C denotes the cyan image forming unit and 2K denotes the black image forming unit. In the following description, the reference numeral of each of the other components of the image forming apparatus is suffixed by Y, M, C or K to indicate the related color of the component.

The image forming units 2Y, 2M, 2C and 2K by turn have respective photosensitive bodies 3Y, 3M, 3C and 3K that are latent image carriers. Each of the photosensitive bodies 3Y, 3M, 3C and 3K of the first example shown in FIG. 1 is formed by using a photosensitive drum. However, each of the photosensitive bodies 3Y, 3M, 3C and 3K may alternatively be formed by using an endless belt.

The photosensitive bodies 3Y, 3M, 3C and 3K are driven to rotate clockwise in FIG. 1 as indicated by arrows $\alpha$ in operation. Like known image forming apparatus adapted to use liquid developers, each of the image forming units 2Y, 2M, 2C and 2K includes a charging member, an exposure device, a liquid development device, a photosensitive body squeezing device, a charge elimination device and a photosensitive body cleaning device that are arranged around the photosensitive body 3Y, 3M, 3C or 3K and not shown. The charging member, the exposure device, the liquid development device, the photosensitive body squeezing device, the charge elimination device and the photosensitive body cleaning device are arranged sequentially in the mentioned order around the corresponding one of the photosensitive bodies 3Y, 3M, 3C and 3K in the sense of rotation of the photosensitive body. Thus, an electrostatic latent image of the corresponding color is formed on each of the photosensitive bodies 3Y, 3M, 3C and 3K and the electrostatic latent images of the different colors are developed by the respective liquid developers to become toner images.

As shown in FIG. 1, the image forming apparatus 1 further includes an intermediate transfer belt 4 that is an endless belt and operates as transfer medium, although the transfer medium may alternatively be formed by using a transfer roller. The transfer medium is an intermediate transfer belt 4 in the following description.

The intermediate transfer belt 4 is wound around a belt driving roller 5, to which drive force of a motor (not shown) is transmitted, and a pair of follower rollers 6 and 7. The belt driving roller 5 and one of the follower rollers, or the follower roller 6, are arranged adjacently relative to each other with a predetermined gap interposed between them along the transfer material moving direction $\beta$ indicated by an arrow in FIG. 1, the transfer material 8 being typically a sheet of paper being conveyed toward a secondary transfer device 14, which will be described in greater detail hereinafter. The belt driving roller 5 and the other follower roller 7 are separated from each other by a large distance and arranged in the direction of tandem arrangement of the photosensitive bodies 3Y, 3M, 3C and 3K. The intermediate transfer belt 4 is subjected to tension of a predetermined level by a tension roller 9. The intermediate transfer belt 4 can be driven to rotate counterclockwise as indicated by arrow $\gamma$ in FIG. 1 by the belt driving roller 5.

The image forming units 2Y, 2M, 2C and 2K are arranged in the order of the colors of Y, M, C and K from the upstream side (the left side in FIG. 1) in the sense of rotation γ of the intermediate transfer belt 4 in this first example of the image forming apparatus 1, although the order of arrangement of the colors of Y, M, C and K may be arbitrarily decided.

Primary transfer devices 10Y, 10M, 10C and 10K are arranged respectively around the photosensitive bodies 3Y, 3M, 3C and 3K. Each of the primary transfer devices 10Y, 10M, 10C and 10K is arranged between the photosensitive body squeezing device and the charge elimination device that are not shown. The primary transfer devices 10Y, 10M, 10C and 10K have respective backup rollers 11Y, 11M, 11C and 11K for primary transfer. The intermediate transfer belt 4 is brought into contact and pressed against the photosensitive bodies 3Y, 3M, 3C and 3K respectively by the backup rollers 11Y, 11M, 11C and 11K.

As an electric charge showing the polarity opposite to the polarity of the electric charge of toner particles is applied to the backup rollers 11Y, 11M, 11C and 11K, the toner images on the photosensitive bodies 3Y, 3M, 3C and 3K are transferred sequentially onto the intermediate transfer belt 4. More specifically, the yellow (Y) toner image is transferred onto the intermediate transfer belt 4 first and the magenta (M) toner image is transferred onto the intermediate transfer belt 4 next so as to be laid on the yellow (Y) toner image. Subsequently, the cyan (C) toner image and the black (K) toner image are sequentially laid on the toner images that are already on the intermediate transfer belt 4 one on the other to form a full color toner image on the intermediate transfer belt 4.

Intermediate transfer belt squeezing devices 12Y, 12M, 12C and 12K are respectively arranged near the primary transfer devices 10Y, 10M, 10C and 10K at downstream positions in the sense of rotation γ of the intermediate transfer belt 4 relative to the primary transfer devices 10Y, 10M, 10C and 10K. The intermediate transfer belt squeezing devices 12Y, 12M, 12C and 12K are provided with respective intermediate transfer belt squeezing rollers 13Y, 13M, 13C and 13K. The intermediate transfer belt squeezing rollers 13Y, 13M, 13C and 13K are for collecting carrier liquids of the corresponding colors on the intermediate transfer belt 4.

Additionally, a secondary transfer device 14 is arranged at the side of the belt driving roller 5 of the intermediate transfer belt 4. The secondary transfer device 14 includes a transfer roller 15. The transfer roller 15 is arranged opposite to the belt driving roller 5 and held in contact with and pressed against the intermediate transfer belt 4 that is wound around the belt driving roller 5. As the transfer material 8 is pinched at the transfer nip section between the transfer roller 15 and the intermediate transfer belt 4 under pressure and forced to move in the transfer material moving direction β, the toner image (liquid developer image) on the intermediate transfer belt 4 is transferred onto the transfer material 8. Therefore, the intermediate transfer belt 4 also operates as transfer material moving member and liquid developer image carrier for the purpose of the present invention.

Although not shown, the image forming apparatus 1 of this first example has a transfer material containing device for containing transfer materials 8, which may typically be sheets of paper, and a pair of registration rollers for conveying and supplying a transfer material 8 from the transfer material containing device to the secondary transfer device 14 at the upstream side relative to the secondary transfer device 14 in the transfer material conveying direction. The image forming apparatus 1 also has a fixing device and a discharged transfer material receiving tray at the downstream relative to the secondary transfer device 14 in the sense of the transfer material conveying direction. A transfer material belt conveyance device 16 for conveying the transfer material 8 from the secondary transfer device 14 to the fixing device is partly shown in FIG. 1.

Figure 2:
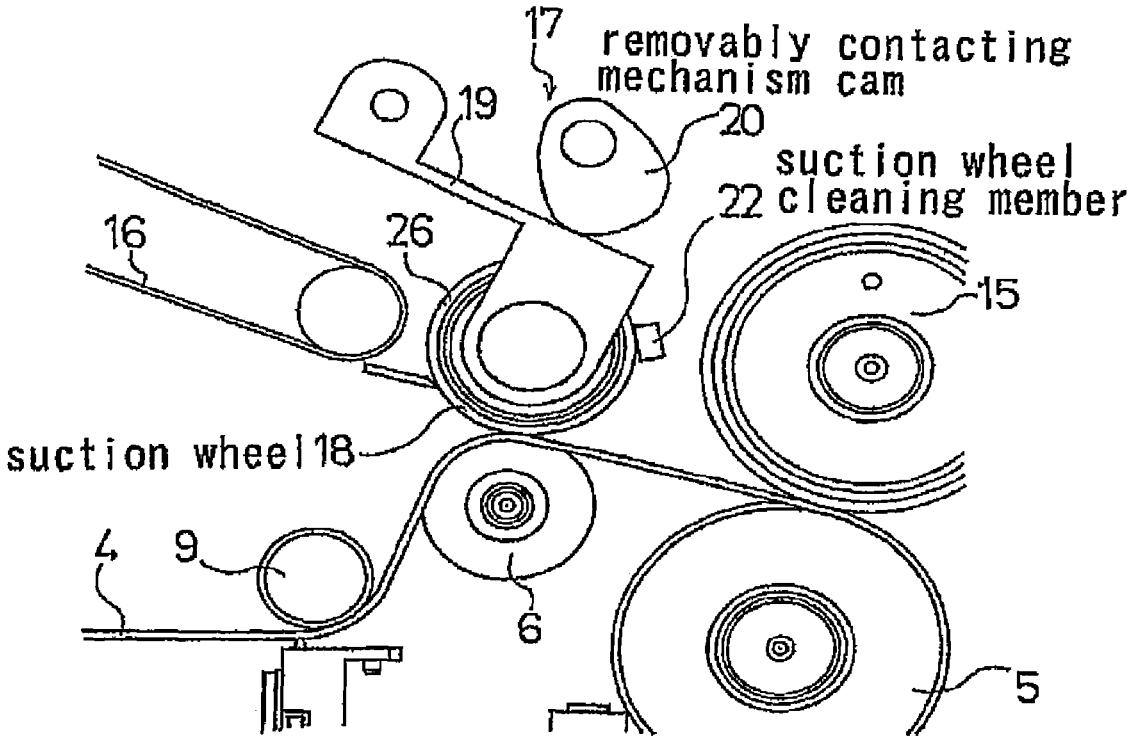
FIG. 2 is an enlarged schematic view of part II in FIG. 1.
Figure 3B:
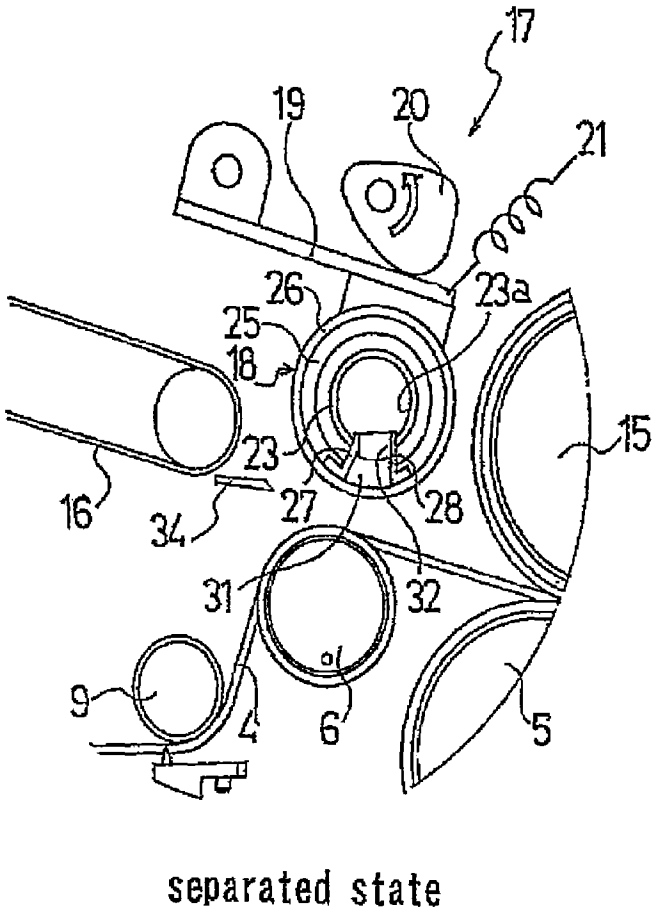
FIG. 3A is a schematic illustration of a state where the suction wheel outer ring is held in contact with the intermediate transfer belt and FIG. 3B is a schematic illustration of a state where the suction wheel outer ring is separated from the intermediate transfer belt.
Figure 3A:
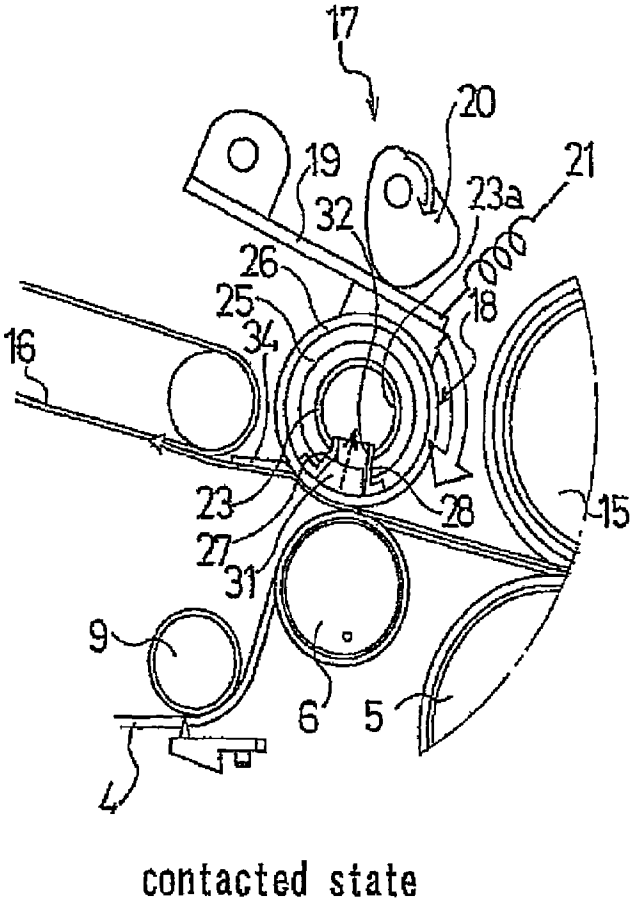

As shown in FIG. 1, the secondary transfer device 14 has a transfer material separating device 17 arranged adjacent to the tail end of the transfer nip section. Referring to FIGS. 2, 3A and 3B that show the transfer material separating device 17 in detail, the transfer material separating device 17 includes suction wheels 18 that are vacuum wheels arranged so as to be removably brought into contact with the intermediate transfer belt 4 at a position facing the follower roller 6, a suction wheel support lever 19 arranged at the device main body so as to be able to pivot and support the suction wheel 18, a cam 20 that urges the suction wheel support lever 19 to turn, a spring 21 that constantly urges the suction wheel support lever 19 so as to separate the suction wheel 18 from the intermediate transfer belt 4 and a suction wheel cleaning members 22 respectively held in contact with the outer peripheral surfaces of the suction wheels 18 to clean the suction wheels 18. Thus, a transfer material separation/suction section is formed by suction wheels 18, a suction wheel support lever 19, a cam 20 and a spring 21 for this example according to the embodiment of the present invention.

Figure 4:
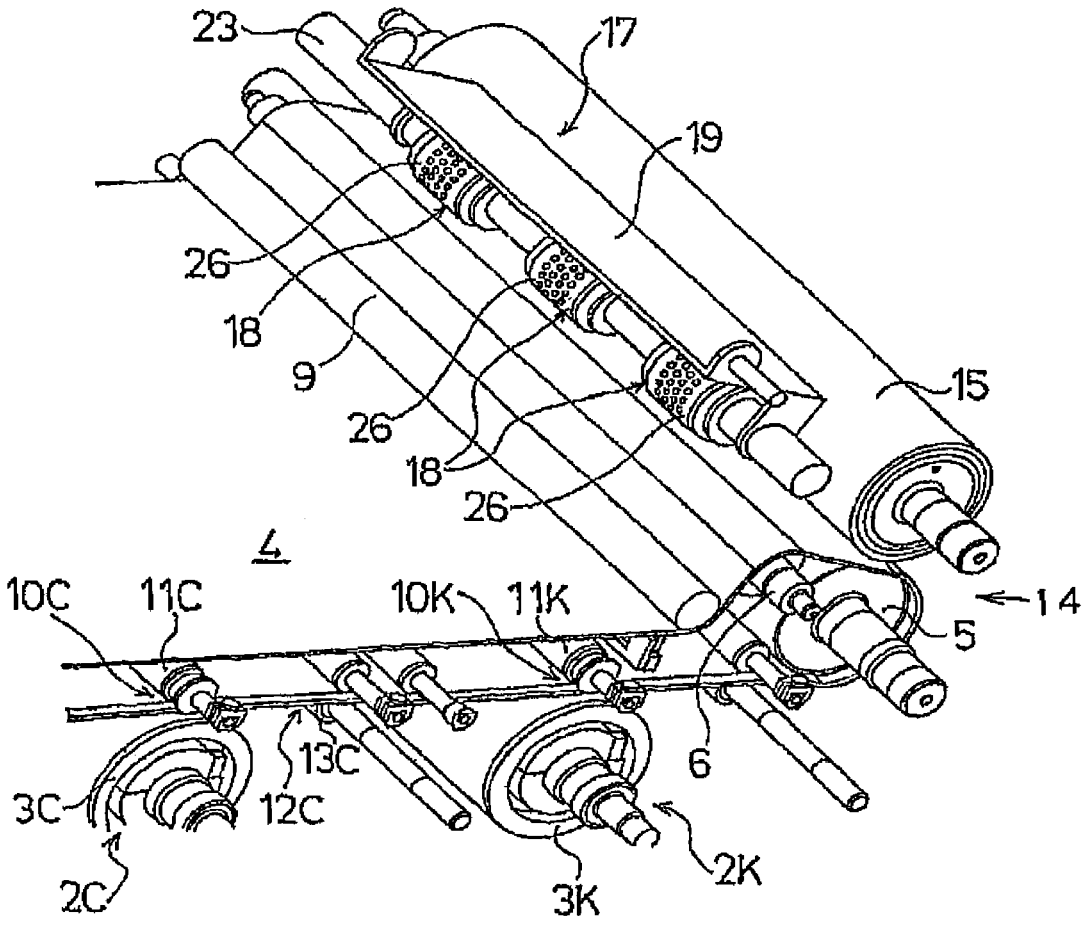
FIG. 4 is a schematic perspective view of the transfer material separating device of the first example of the embodiment of FIG. 1.
Figure 5:
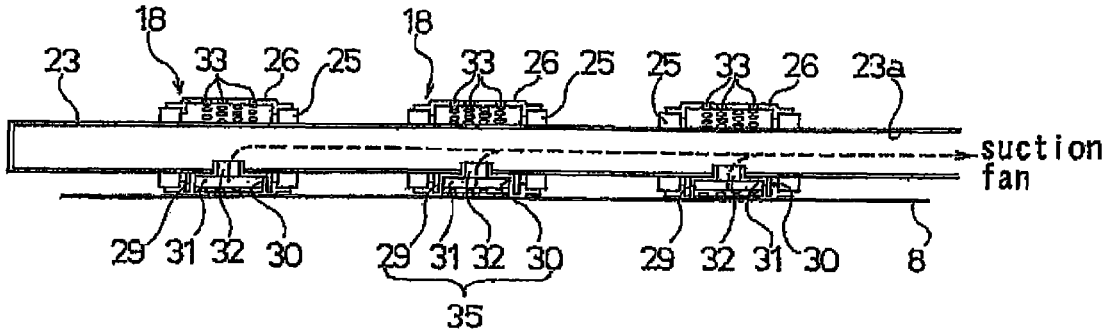
FIG. 5 is a schematic cross-sectional view of the suction wheel of the first example of the embodiment of FIG. 1.

As shown in FIGS. 4 and 5, three suction wheels 18 are arranged on a hollow cylindrical shaft 23 and axially separated from each other by predetermined intervals. The hollow cylindrical shaft 23 is closed at one of the opposite ends thereof and connected at the opposite end to a suction device such as suction fan (not shown). The three suction wheels 18 are same and identical in terms of structure and configuration.

Figure 6:
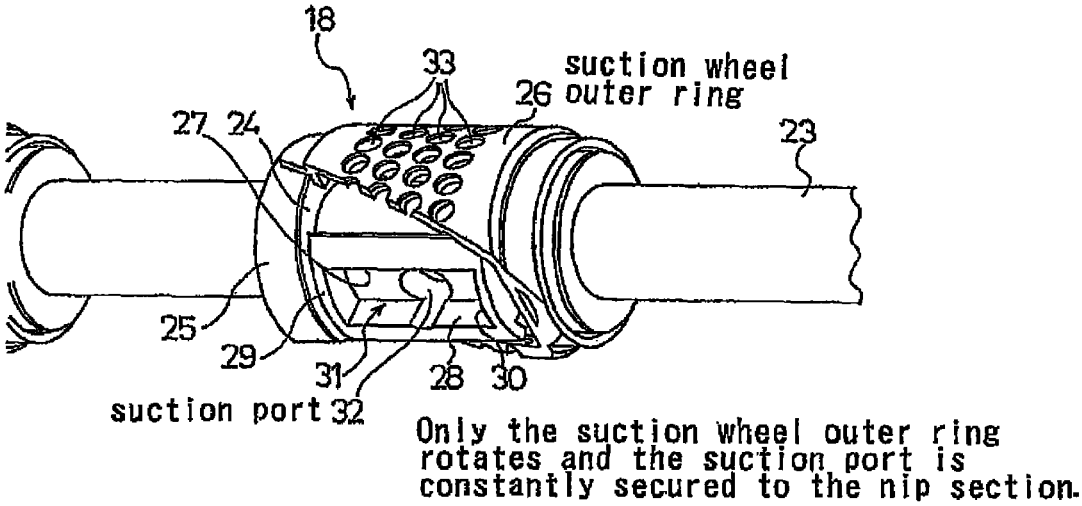
FIG. 6 is a schematic partially cut-out perspective view of the suction wheel of FIG. 5.

Referring to FIGS. 5 and 6, each of the suction wheels 18 has a cylindrical projecting section 25 integrally arranged on the cylindrical shaft 23 and provided with an annular recessed section 24 and a cylindrical suction wheel outer ring 26 rotatably arranged to cover the annular recessed section 24. A pair of axial partition walls 27 and 28 are arranged so as to extend in the axial direction and separated from each other, while a pair of radial partition walls 29 and 30 are arranged so as to extend in a radial direction and separated from each other. The top surfaces of the axial partition walls 27 and 28 and those of the radial partition walls 29 and 30 are flush with the outer peripheral surface of the axial opposite end parts of the projecting section 25 (the parts other than the recessed section 24). Thus, an arced recessed section 31 having a relatively small volume and separated from the recessed section 24 is defined by the axial partition walls 27 and 28 and the radial partition walls 29 and 30.

The recessed section 31 of each of the suction wheels 18 is provided with a suction port 32 that communicates with the inner hole 23 of the hollow cylindrical shaft 23. In other words, the recessed section 31 is constantly in communication with the inner hole 23*a* of the shaft 23 by way of the suction port 32. A suction nozzle 35 is formed by the pair of axial partition walls 27 and 28 and the pair of radial partition walls 29 and 30 to suck external air through the inner hole 23*a* of the shaft 23. The cylindrical shaft 23 and the nozzle 35 are arranged so as to be unrotatable and axially immovable.

As shown in FIG. 3A, in a state where the suction wheels 18 are held in contact with the intermediate transfer belt 4, the contact position of each of the suction wheels 18 and the intermediate transfer belt 4 is located slightly at the side of the transfer material conveyance device 16 relative to the contact point of the follower roller 6 and the intermediate transfer belt 4. With this arrangement, the front edge of the transfer material 8 is effectively sucked by the suction wheel 18 by utilizing the head margin of the transfer material 8 that can easily be peeled off from the intermediate transfer belt 4.

Additionally, in a state where the suction wheels 18 are held in contact with the intermediate transfer belt 4, the recessed section 31 of each of the suction wheels 18 extends from the proximal end thereof located upstream relative to the contact point of the follower roller 6 and the intermediate transfer belt 4 in terms of the moving direction of the intermediate transfer belt 4 to the distal end thereof located downstream and beyond the peeled off front edge part of the transfer material 8 (downstream relative to the contact point in terms of the moving direction) at the side of the transfer material belt conveyance device 16. Therefore, when the nozzle 35 is set in a state as shown in FIG. 3A, the nozzle 35 always faces the peeled off part of the transfer material 8.

Additionally, the suction wheel outer ring 26 is arranged such that the inner peripheral surfaces thereof is slidable on the outer peripheral surface of the axial opposite end parts of the projecting section 25 (the parts other than the recessed sectioned section 24), on the top surfaces of the axial partition walls 27 and 28 and those of the radial partition walls 29 and 30 but axially immovable relative to the projecting section 25. The suction wheel outer ring 26 is provided with a large number of through holes 33 that run through between the outside and the inside of the suction wheel outer ring 26. The through holes 33 are arranged in a plurality of endless peripheral rows (four rows in the drawings) extending arranged side by side in the axial direction, all the rows having a same number of holes. Note that the through holes 33 of each of the rows are axially displaced from those of the neighboring row or rows. Thus, the outer peripheral side of the suction wheel outer ring 26 is constantly held in communication with the inner hole 23*a* of the shaft 23 by way of the through holes 33 and the recessed section 31 and the suction port 32 of the nozzle 35. Therefore, as the suction device is driven to operate, air is sucked from the outer periphery of the suction wheel outer ring 26 through the through holes 33 facing the recessed section 31, the recessed section 31, the suction port 32 and the inner hole 23*a* of the shaft 23. The outer diameter of the part of the suction wheel outer ring 26 where the through holes 33 are formed is greater than the outer diameter of the axial opposite end parts of the projecting section 25 (the parts other than the recessed section 24).

The suction wheel support lever 19 rigidly supports the shaft 23 and the suction wheel cleaning member 22. The suction wheel cleaning member 22 is so arranged that it is constantly held in contact with the outer peripheral surface of the part of the suction wheel outer ring 26 where the through holes 33 are formed.

Referring to FIG. 3A, as the suction wheel support lever 19 is urged to turn by the cam 20, it turns clockwise in FIG. 3A to put the suction wheel outer ring 26 to contact with and press it against the intermediate transfer belt 4 that is wound around the follower roller 6. More specifically, the part of the suction wheel outer ring 26 where the through holes 33 are formed is brought into contact with and pressed against the intermediate transfer belt 4. In a state where the suction wheel outer ring 26 is brought into contact with and pressed against the intermediate transfer belt 4, the recessed section 31 of the projecting section 25 and hence the suction port 32 face the intermediate transfer belt 4.

On the other hand, referring to FIG. 3B, as the effort of the cam 20 for urging the suction wheel support lever 19 is released, the suction wheel support lever 19 is forced to turn counterclockwise in FIG. 3B and move the suction wheel outer ring 26 away from the intermediate transfer belt 4 by the urging force of the spring 21.

When the transfer material 8 is conveyed away after the image transfer process, the suction wheel outer ring 26 is brought into contact with and pressed against the intermediate transfer belt 4 so as to be turned with the latter by the effort of the cam 20. Thus, the suction device is driven to operate. The force by which the suction wheel outer ring 26 is brought into contact with and pressed against the intermediate transfer belt 4 is appropriately selected by taking the service life of the intermediate transfer belt 4 and the suction force of the suction wheel outer ring 26 into consideration. Then, as a result, the transfer material 8 that is being conveyed is sucked by the suction wheel outer ring 26 at the second surface thereof that is opposite to the first surface, or the transfer surface where the liquid developer image is transferred. Since the volume of the recessed section 31 and the capacity of the suction port 32 are relatively small, the air that is sucked by the suction device is substantially entirely sucked through the through holes 33 arranged at the contact surface of the suction wheel outer ring 26 that contacts the transfer material 8. Thus, the suction force by which the transfer material 8 is sucked by the suction wheel outer ring 26 is secured to such a level that it can reliably separate the transfer material 8 from the intermediate transfer belt 4.

The transfer material 8 is separated from the intermediate transfer belt 4 in this way. Additionally, the transfer material 8 is driven to move as the suction wheel outer ring 26 rotates but the part of the transfer material 8 that is off the recessed section 31 and hence the suction port 32 is not sucked. In other words, only the part of the transfer material 8 that directly faces the recessed section 31 is sucked by the suction wheel outer ring 26 and the transfer material 8 is conveyed as a result. Then, as the front edge of the transfer material 8 hits guide member 34 arranged adjacent to the suction wheel 18, the transfer material 8 is separated from the suction wheel outer ring 26 and led toward the transfer material belt conveyance device 16. Since the part of the transfer material 8 that hits the guide member 34 is not sucked by the suction wheel outer ring 26, it can easily move toward the guide member 34. Additionally, as the suction wheel outer ring 26 rotates, the residual toner and the foreign objects such as dust adhering to the outer peripheral surface of the suction wheel outer ring 26 are removed by the cleaning member 22.

On the other hand, when there is not any transfer material 8 to be conveyed away after a transfer of an image, as shown in FIG. 3B, the suction wheel outer ring 26 is removed away from the intermediate transfer belt 4 and the suction device is made to stop operating. Then, as a result, possible smearing of the next transfer material 8 by the residual toner and the foreign objects such as dust adhering to the outer peripheral surface of the suction wheel outer ring 26 from the intermediate transfer belt 4 is suppressed.

With the image forming apparatus 1 of the first example having such a transfer material separating device 17, the transfer material 8 is sucked by the suction wheel outer ring 26 of the suction wheel 18 at the surface thereof opposite to the transfer surface after the transfer process. Therefore, the transfer material 8 can be reliably separated from the intermediate transfer belt 4 as the transfer material 8 is sucked by the suction device. Thus, the liquid developer image transferred onto the transfer material 8 is prevented from being adversely influenced by the suction because the transfer material is sucked at the surface thereof that is opposite to the transfer surface.

A predetermined number of through holes are formed through the suction wheel outer ring 26 over the entire outer peripheral surface thereof. Therefore, if the suction wheel outer ring 26 is rotated with the move of the transfer material 8 and the intermediate transfer belt 4, the transfer material 8 is constantly sucked so long as the suction wheel outer ring 26 is operating for sucking the transfer material 8. Additionally, since air is sucked by way of the recessed section 31 having a small volume and the suction port 32 having a small capacity that constantly face the transfer material 8 in a sucking operation, the power for sucking the transfer material 8 can be effectively secured to such a level that the transfer material 8 is reliably separated from the intermediate transfer belt. In other words, the capacity of the suction device can be minimized. Additionally, since the transfer material 8 is not sucked by the suction wheel outer ring 26 once the transfer material 8 is moved away from the recessed section 31 and hence from the suction port 32, the transfer material 8 can be smoothly moved to the next conveyance site.

Furthermore, since the suction wheel outer ring 26 is so arranged that it can be removably brought into contact with the intermediate transfer belt 4, the suction wheel outer ring 26 can be brought into contact with the intermediate transfer belt 4 only during the conveyance of a transfer material 8 and separated from the intermediate transfer belt 4 when a transfer material 8 is not being conveyed. Thus, any residual toner and foreign objects such as dust can be prevented from adhering to the outer peripheral surface of the suction wheel outer ring 26 from the intermediate transfer belt 4. Thus, as a result, any possible smearing of the transfer material 8 when the transfer material 8 is being sucked is effectively suppressed.

Still additionally, since the cleaning member 22 is arranged and held in contact with the outer peripheral surface of the suction wheel outer ring 26, the foreign objects adhering to the outer peripheral surface of the suction wheel outer ring 26 can be automatically removed by the cleaning member 22 while the suction wheel outer ring 26 is rotating. Then, as a result, the suction wheel outer ring 26 can operate to stably suck transfer materials 8 without smearing them for a long period of time.

Figure 7:
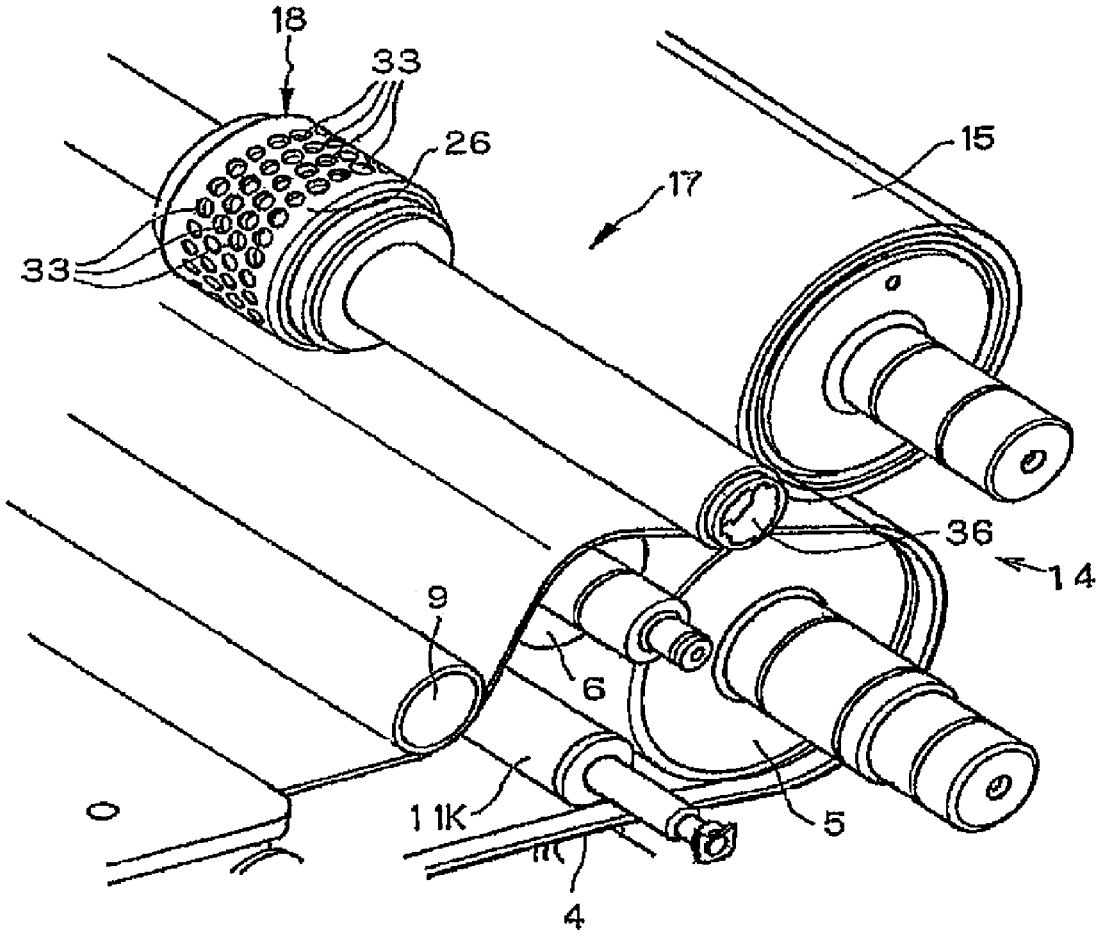
FIG. 7 is an enlarged schematic perspective view of part of the second example of the embodiment of the image forming apparatus according to the present invention.

FIG. 7 is an enlarged schematic perspective view of part of the second example of the embodiment of the image forming apparatus according to the present invention.

Referring to FIG. 7, a filter 36 is arranged at the side of the suction device in the hollow cylindrical shaft 23 of the image forming apparatus 1 of the second example. Thus, the toner (solid ingredient) and the liquid carrier (oil) of the liquid developer that is sucked with air by the suction device are removed by the filter 36. Then, as a result, the toner (solid ingredient) and the liquid carrier (oil) are prevented from being sucked into the suction device and the suction device is prevented from being smeared.

Otherwise, the image forming apparatus 1 of the second example is same as that of the first example in terms of configuration, effect and advantage.

Figures 8A, 8B:
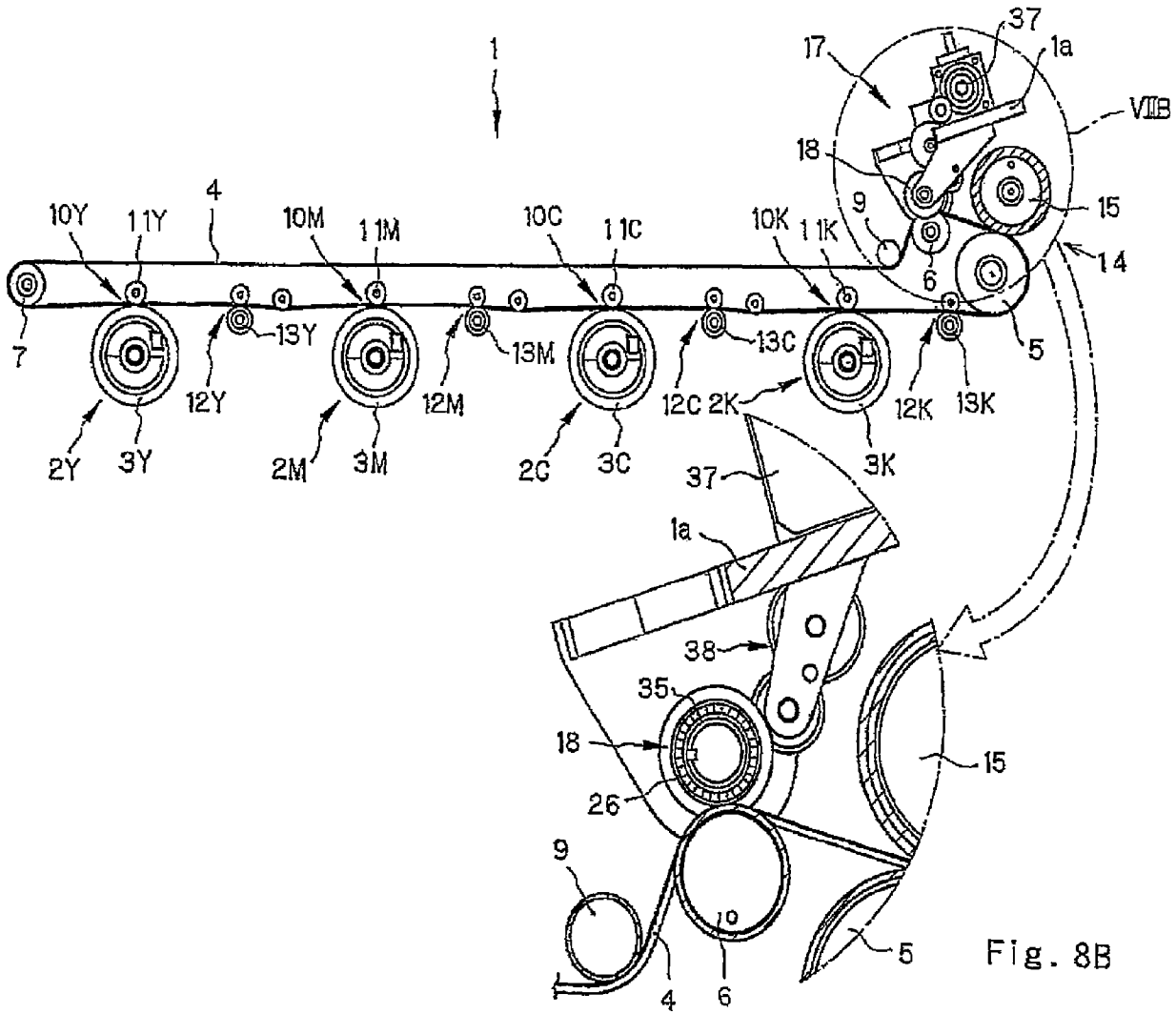
FIG. 8A is a schematic partial view similar to FIG. 1, showing the third example of the embodiment of the image forming apparatus according to the present invention
FIG. 8B is an enlarged schematic view of part VIIIB in FIG. 8A.

FIG. 8A is a schematic partial view similar to FIG. 1, showing the third example of the embodiment of the image forming apparatus according to the present invention and FIG. 8B is an enlarged schematic view of part VIIIB in FIG. 8A.

In the image forming apparatus 1 of the first and second examples described above, the nozzle 35 cannot be rotated. However, in the image forming apparatus 1 of the third example, the nozzle 35 is arranged so as to be rotatable similarly to the suction wheel outer ring 26.

Figure 9:
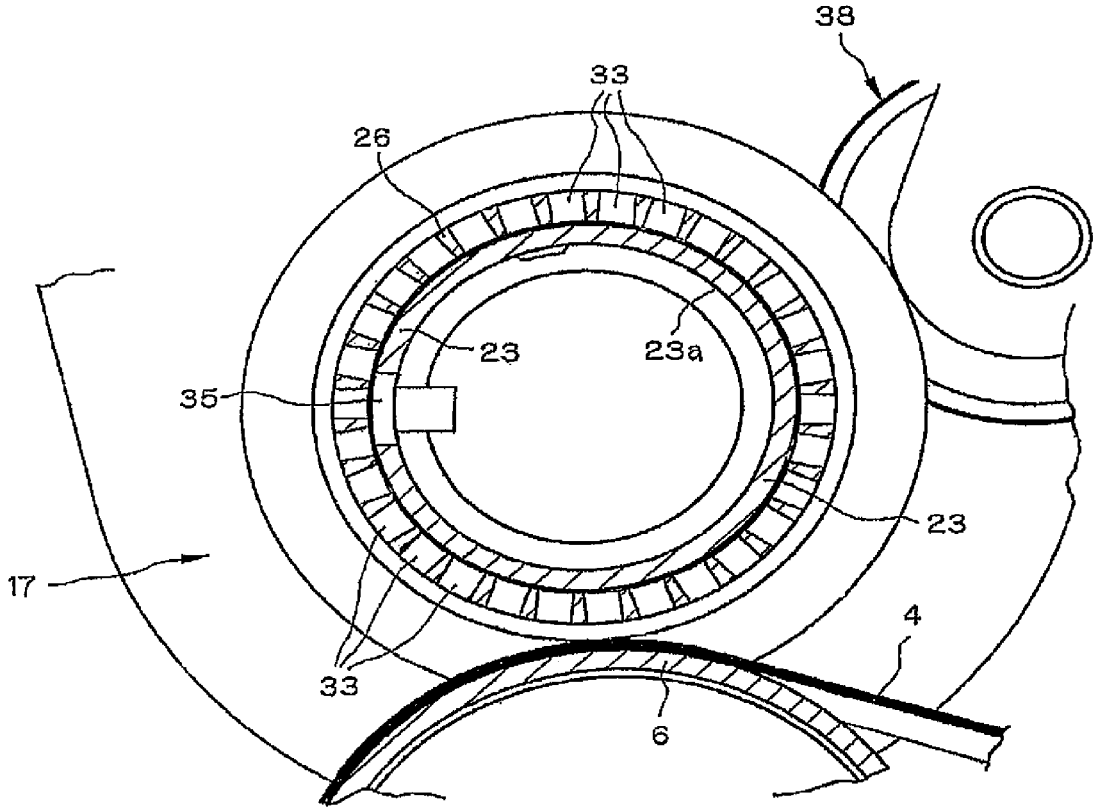
FIG. 9 is an enlarged schematic transversal cross-sectional view of the suction wheel of the third example.
Figure 10A:
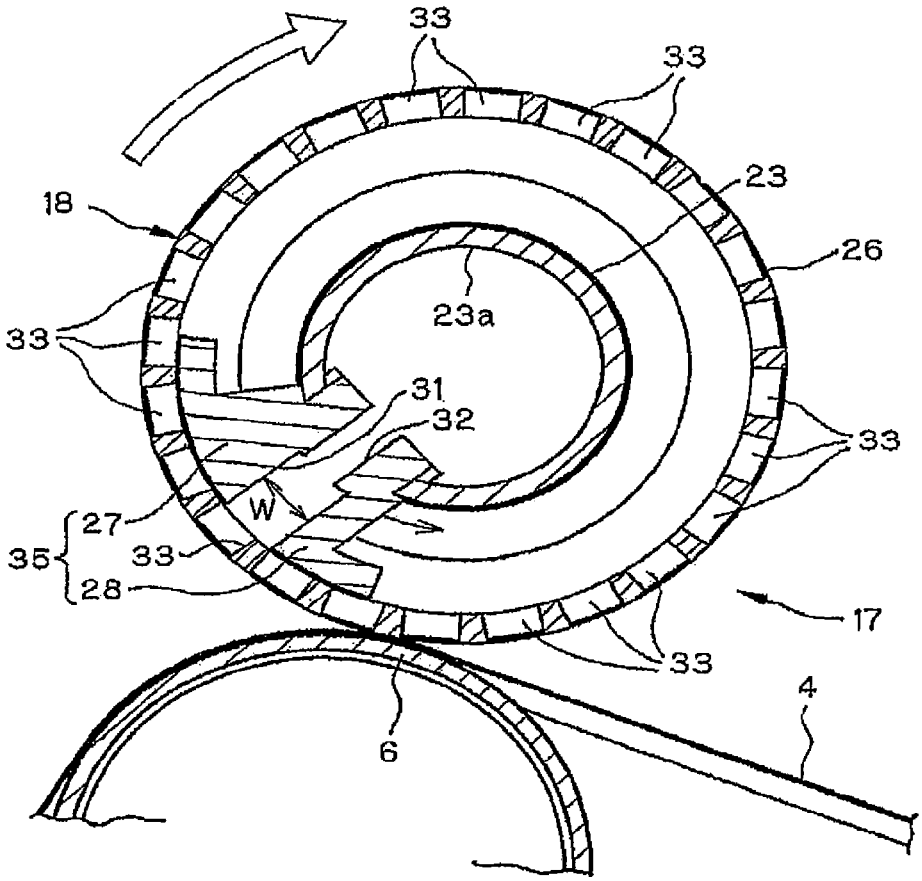
FIG. 10A is an enlarged schematic transversal cross-sectional view of the nozzle of the suction wheel of the third example and FIG. 10B is a front view of the nozzle.
Figure 10B:
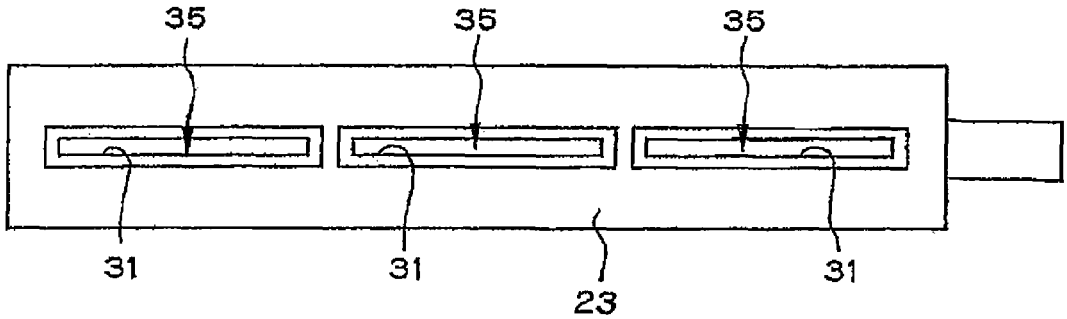

Referring now to FIGS. 8A and 9, the outer peripheral surface of the suction wheel outer ring 26 of the suction wheel 18 of the third example is arranged opposite to the intermediate transfer belt 4 with a small gap interposed between them. Additionally, the nozzle 35 of the third example is formed in the cylindrical shaft 23. More specifically, as shown in FIG. 10A, the nozzle 35 is formed by a pair of axial partition walls 27 and 28 and another pair of partition walls 29 and 30 (not shown in FIG. 10A but same as those of the first example) as those of the first and second examples. The nozzle 35 has an arced outer peripheral surface and its outer diameter is same as the inner diameter of the suction wheel outer ring 26. In the third example, the peripheral width of the arced recessed section 31 of the nozzle 35 is considerably smaller than that of the nozzle 35 of the first example and that of the nozzle 35 of the second example. In the illustrated instance, the peripheral width W of the recessed section 31 is slightly greater than the diameter of the through holes 33 of the suction wheel outer ring 26. Additionally, FIG. 10B shows three nozzles 35 that have an oblong profile extending in the axial direction of the shaft 23 and are arranged on a straight line. However, the nozzles 35 may be replaced by a single nozzle longer than those of FIG. 10B or two or four or more than four similar nozzles.

Figure 11A:
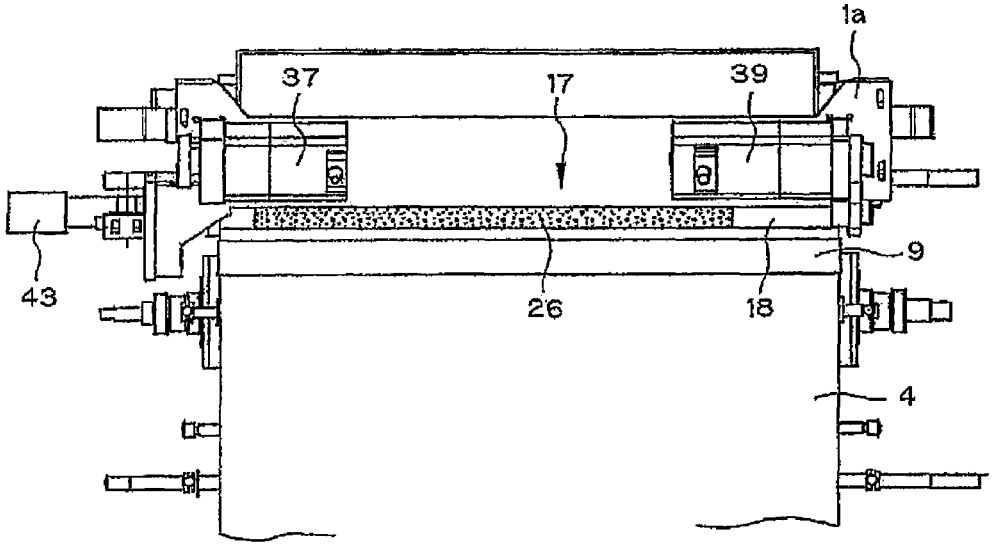
FIG. 11A is a partial schematic plan view of the third example of the embodiment of the image forming apparatus and FIG. 11B is a partial schematic cross-sectional view of the third example of the image forming apparatus.
Figure 11B:
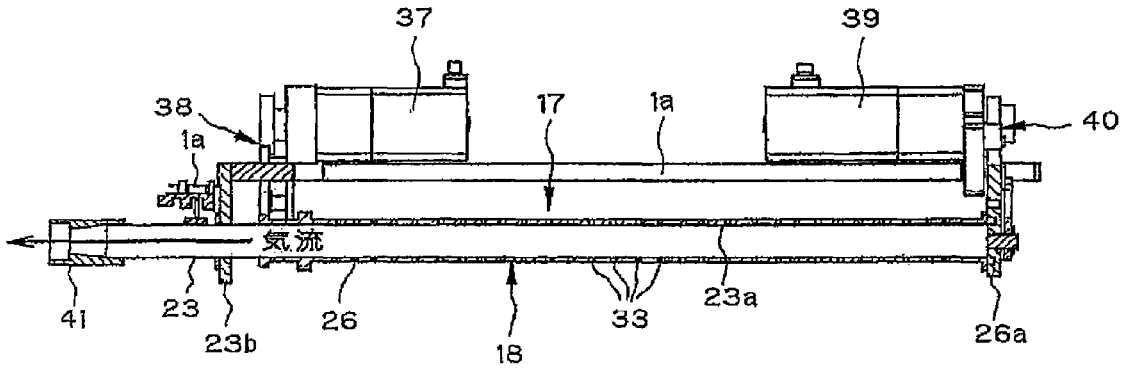
Figure 12:
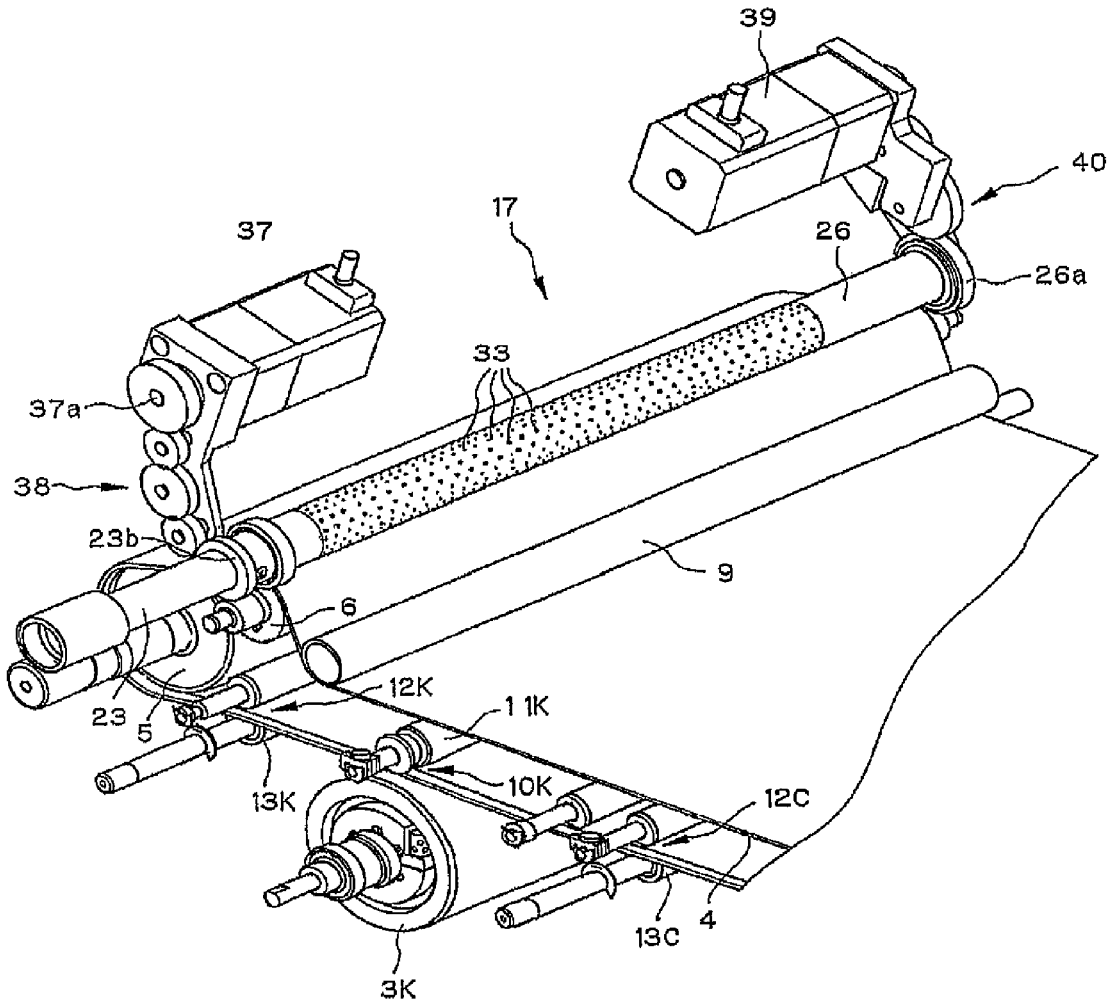
FIG. 12 is a partial schematic perspective view of the transfer material separating device of the third example.

As shown in FIGS. 11A, 11B and 12, a shaft drive motor 37 is arranged in the main body 1*a* of the image forming apparatus 1 in order to drive the shaft 23 to rotate. The rotary shaft 37*a* of the shaft drive motor 37 is connected to a gear 23*b* arranged on the outer periphery of the shaft 33 by way of a power transmission gear system 38. With this arrangement, the speed of the rotary motion of the shaft drive motor 37 is reduced by the power transmission gear system 38 and the rotary power of the shaft drive motor 37 is transmitted to the gear 23*b* in order to drive the shaft 23 to rotate integrally with the nozzle 35.

Figure 13:
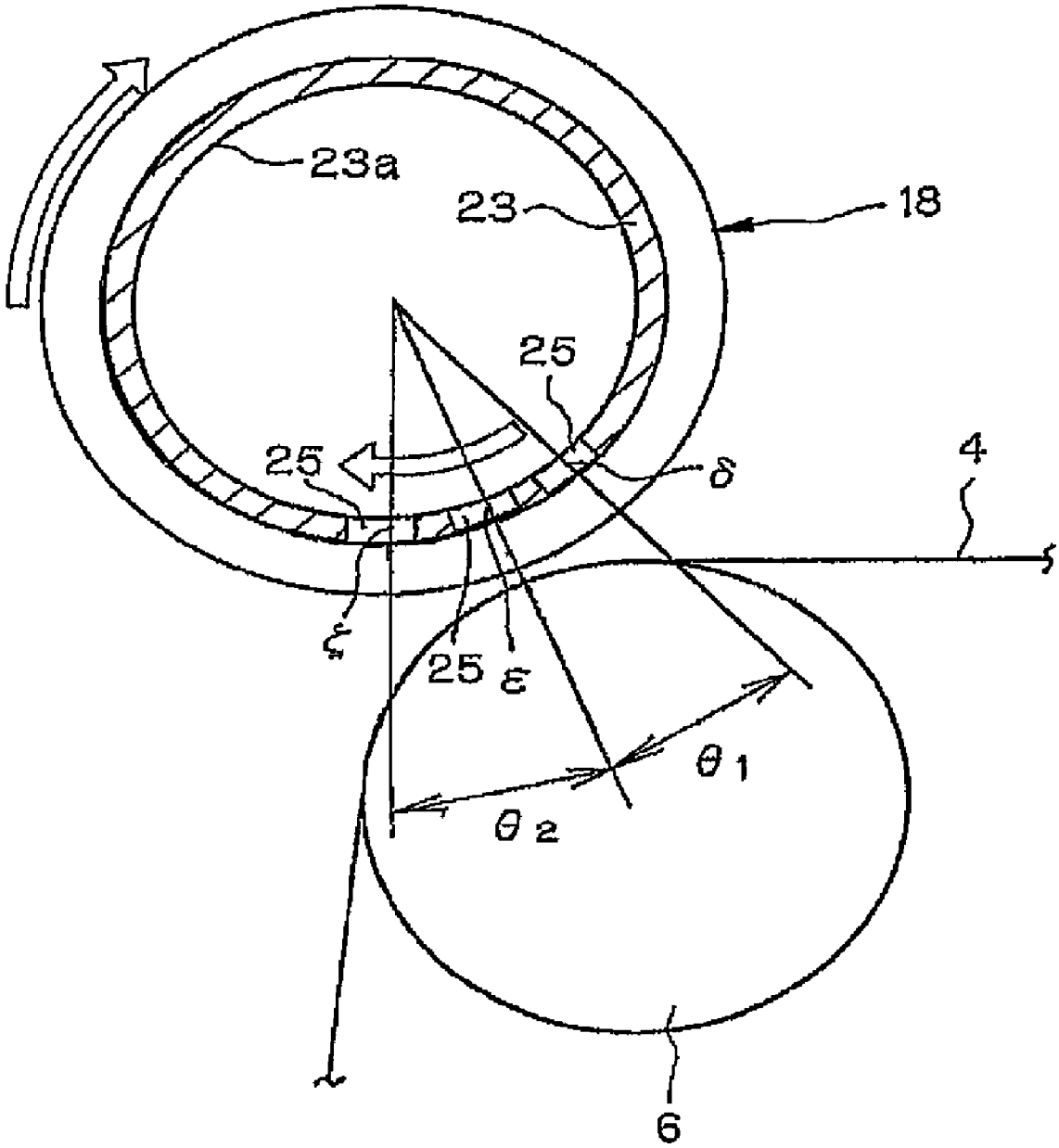
FIG. 13 is a schematic illustration of the operation of the nozzle of the third example.

The shaft drive motor 37 is adapted to drive the shaft 23 to turn by a predetermined angle (e.g., 30°) to reciprocate. More specifically, as shown in FIG. 13, the recessed section 31 of the nozzle 35 turns from initial standby position $\delta$ to sucking position $\epsilon$ that is separated from the standby position $\delta$ by a first predetermined angle $\theta_1$ (e.g., about 15°) and then to suction release position $\zeta$ that is separated from the sucking position $\epsilon$ by a second predetermined angle $\theta_2$ (e.g., about 15°) and then turns back for reciprocation.

Furthermore, while three suction wheel outer rings 26 are arranged in the axial direction in the first and second examples, a single oblong suction wheel outer ring 26 is arranged in the image forming apparatus 1 of the third example. An outer ring drive motor 39 for driving the suction wheel outer ring 26 to rotate is arranged in the main body 1*a* of the image forming apparatus 1. The rotary shaft (not shown) of the outer ring drive motor 39 is connected to the gear 26*a* arranged on the outer periphery of the suction wheel outer ring 26 by way of power transmission gear system 40. With this arrangement, the speed of the rotary motion of the outer ring drive motor 39 is reduced by the power transmission gear system 40 and the rotary power of the outer ring drive motor 39 is transmitted to the gear 26*a* in order to drive the suction wheel outer ring 26 to rotate. Note that the outer ring drive motor 39 drives the suction wheel outer ring 26 to turn for reciprocation at the speed same as the process speed of the image forming apparatus 1 (more specifically the peripheral speed of the suction wheel outer ring 26 is made equal to the moving speed of the intermediate transfer belt 4) without limiting the turning angle of the suction wheel outer ring 26.

Figure 14:
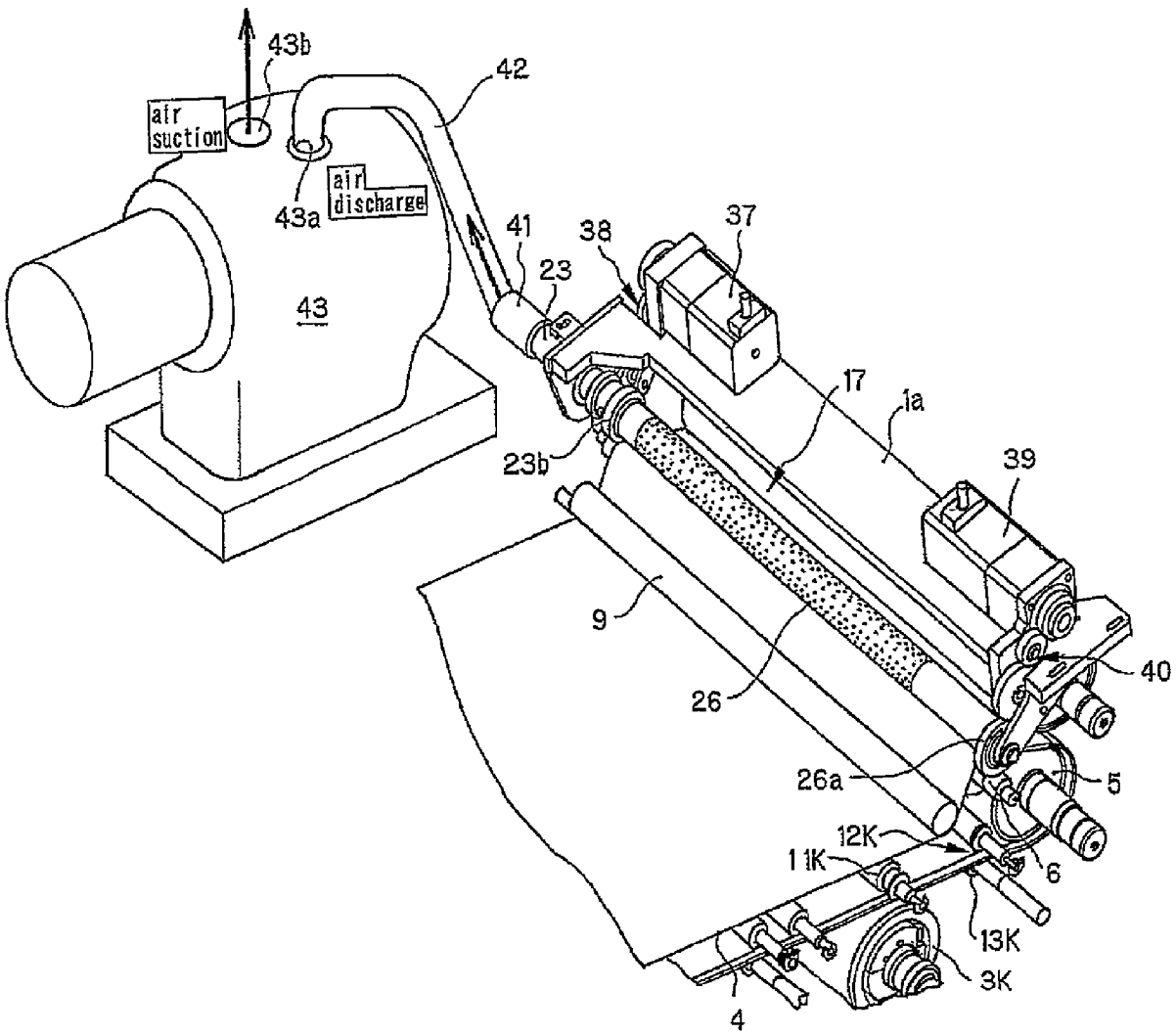
FIG. 14 is a partial schematic perspective view of the transfer material separating device of the third example, showing the connection thereof to the vacuum pump.

As shown in FIG. 14, the open end of the shaft 23 is connected to a hose 42 by way of a coupling 41, and the hose 42 is by turn connected to the suction port 43*a* of a vacuum pump 43. The vacuum pump 43 sucks air in the inside of the inner hole 23*a* of the shaft 23 and discharges it to the outside by way of an exhaust port 43*b*. The hose 42 is prevented from turning and being twisted due to the coupling 41 if the shaft 23 rotates so that the airtight connection of the shaft 23 and the hose 42 is stably maintained.

Now, the operation of the nozzle 35 for sucking the front edge of a transfer material 8 will be described below.

Figure 15A:
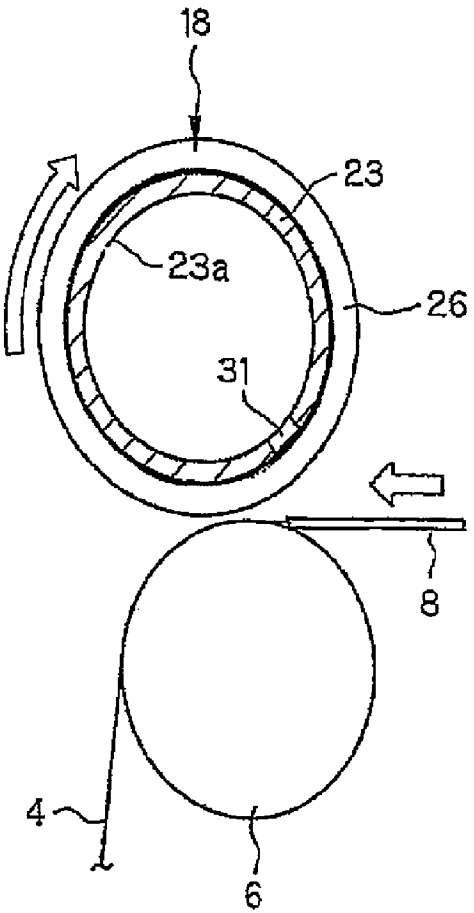
FIGS. 15A through 15C are schematic illustrations of the sucking operation of the nozzle of the third example.

Referring to FIG. 15A, a transfer material 8 is conveyed from the right side in a state where the recessed section 31 of the nozzle 35 is in a standby state δ. As the front edge of the transfer material 8 gets to a position slightly in front of the position where the front edge is pinched between the intermediate transfer belt 4 and the suction wheel outer ring 26 as viewed in the moving direction of the transfer material 8, the shaft drive motor 37 starts operating and drives the shaft 23 integrally with the nozzle 35. At the same time, the outer ring drive motor 39 also starts operating and drives the suction wheel outer ring 26 to rotate. At this time, the rotary motion of the shaft 23, that of the nozzle 35 and that of the suction wheel outer ring 26 are synchronized so as to match to the transfer material conveying speed under the slow up control.

Figure 15B:
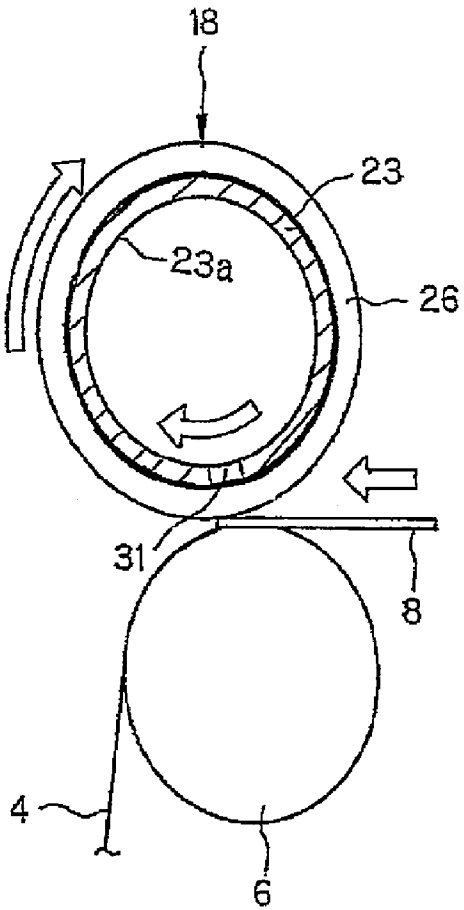

Then, referring to FIG. 15B, the front edge of the transfer material 8 is pinched between the intermediate transfer belt 4 and the suction wheel outer ring 26 and subsequently gets to the peeling off position where the front edge of the transfer material 8 starts to be peeled off from the intermediate transfer belt 4, when the nozzle 35 exactly gets to the sucking position ϵ. Thus, the nozzle 35 starts sucking the front edge of the transfer material 8 at this time. Since the position of the suction wheel outer ring 26 facing the intermediate transfer belt 4 is located slightly at the side of the transfer material belt conveyance device 16 (at the left side in FIG. 15B) relative to the contact position of the follower roller 6 and the intermediate transfer belt 4, the front edge of the transfer material 8 is effectively sucked by the suction wheel 18 as pointed out above.

Figure 15C:
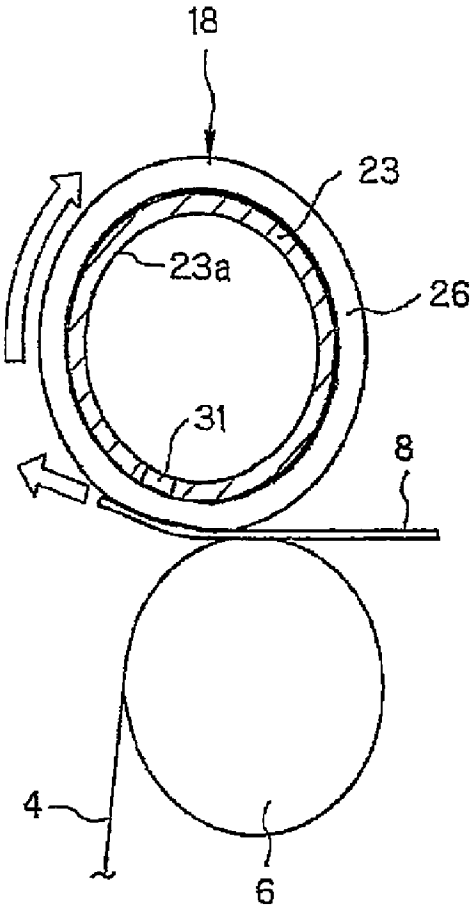

Thereafter, the suction wheel outer ring 26 rotates, while the suction wheel 18 keeps on sucking the front edge of the transfer material 8, and the nozzle 35 is also driven to rotate at a rate of revolution same as the suction wheel outer ring 26 to overrun. The front edge of the transfer material 8 is reliably and stably sucked by the suction wheel 18 as the nozzle 35 is driven to rotate and overrun. Then, as the nozzle 35 gets to the suction release position ζ as shown in FIG. 15C, both the rotary motion of the shaft 23 and that of the nozzle 35 are stopped, although the suction wheel outer ring 26 keeps on rotating. Then, the front edge of the transfer material 8 is located off the recessed section 31 of the nozzle 35 and hence it is no longer sucked by the nozzle 35. As a result, the front edge of the transfer material 8 comes off from the suction wheel 18 as the transfer material 8 is conveyed further toward the transfer material belt conveyance device 16 so that the transfer material 8 becomes sucked and held by the transfer material belt conveyance device 16. On the other hand, the shaft 23 and the nozzle 35 that are forced to stop at the suction release position ζ are then turned reversely and returned to the standby position δ.

With the image forming apparatus 1 of this third example, the nozzle 35 that sucks the front edge of the transfer material 8 is driven to rotate with the suction wheel outer ring 26 so that the front edge of the transfer material 8 is conveyed to the guide position of the transfer material belt conveyance device 16, while the front edge is being reliably sucked by the nozzle 35. Because the rotating nozzle 35 reliably sucks the front edge of the transfer material 8, the peripheral width W of the recessed section 31 of the nozzle 35 can be made smaller than that of the recessed section 31 of the first example and that of the recessed section 31 of the second example. Then, the pressure loss of the suction wheel 18 of this example can be reduced from the level of the first example and that of the second example so that a smaller vacuum pump 43 can be employed for this third example to reduce the manufacturing cost. While a very small gap exists between the outer peripheral surface of the shaft 23 and the inner peripheral surface of the suction wheel 18 and also between the outer peripheral surface of the nozzle 35 and the inner peripheral surface of the suction wheel 18, those small gaps do not significantly affect the pressure loss. Of course, the gaps are desirably made as small as possible from the viewpoint of suppressing the pressure loss.

The image forming apparatus 1 of the third example may be provided with a filter 36 like that of the second example.

Otherwise, the image forming apparatus 1 of the third example is same as that of the first example in terms of configuration, effect and advantage.

The present invention is also applicable to image forming apparatus that do not have any intermediate transfer belt 4 and are so designed that toner images are formed by using liquid developers on the photosensitive bodies 3Y, 3M, 3C and 3K, or the latent image carriers, and then directly transferred onto a transfer material 8. In such a case, the transfer material separating device separates the transfer material from each of the latent image carriers. Thus, the latent image carriers operate as transfer material moving members and liquid developer image carriers for the purpose of the present invention. Additionally, the backup rollers (which correspond to the backup rollers 11Y, 11M, 11C and 11K of any of the above-described examples) for putting the transfer material to contact with and press it against the respective latent image carriers operate as transfer members for the purpose of the present invention.

The present invention is also applicable to four-cycle image forming apparatus. Furthermore, the present invention is applicable to image forming apparatus designed to use a monochromatic liquid developer.

Still additionally, the operation of a transfer material separating device according to the present invention is not limited to separation of the transfer material that is being discharged from the transfer nip section and a transfer material separating device according to the present invention can also be applied to separation of the transfer material that is being discharged from the fixing nip section of a fixing device from the fixing member (fixing roller). In such a case, the transfer material separating device is arranged near the fixing device at a position downstream relative to the downstream end of the fixing nip section as viewed in the transfer material conveying direction. In short, the present invention is applicable to any transfer material separating device so long it is designed to separate a transfer material from a transfer material conveyance device within the scope of the appended claims.

What is claimed is:

1. A transfer material separating device comprising:

a transfer material moving member;

a transfer material separation/suction section that sucks a transfer material held in contact with the transfer material moving member at a first surface of the transfer material and moves with the transfer material moving member at a second surface of the transfer material opposite to the first surface and separates the transfer material from the transfer material moving member, the transfer material separation/suction section including:

a suction wheel provided with a suction wheel outer ring having a cylindrical shaft with a suction port for sucking air and through holes; and a suction wheel removably contacting section that brings the suction wheel into contact with and separate from the transfer material moving member, the suction wheel outer ring being provided so as to cover the cylindrical shaft and to be rotated independently of the cylindrical shaft, the suction port being disposed opposite to the transfer material when the suction wheel outer ring is brought into contact with the transfer material moving member, and the suction wheel outer ring and cylindrical shaft being rotated in the same direction when air is sucked from the suction wheel.

2. The transfer material separating device according to claim 1, wherein the through holes are arranged in multiple numbers in a circumferential direction to form a row, and multiple rows are arranged in an axial direction, and the through holes of each of the rows are axially displaced from those of a neighboring row or rows.

3. The transfer material separating device according to claim 1, comprising a suction wheel cleaning member held in contact with the suction wheel so as to clean the suction wheel.

4. A transfer device comprising:

an image carrier that carries an image;

a transfer roller that transfers the image carried by the image carrier onto a transfer material; and a transfer material separation/suction section that sucks the transfer material onto which the image has been transferred and that is brought into contact with the image carrier so as to separate the transfer material from the image carrier, the transfer material separation/suction section including:

a suction wheel provided with a suction wheel outer ring having a cylindrical shaft with a suction port for sucking air and through holes; and a suction wheel removably contacting section that brings the suction wheel into contact with and separate from the image carrier, the suction wheel outer ring being provided so as to cover the cylindrical shaft and to be rotated independently of the cylindrical shaft, the suction port being disposed opposite to the transfer material when the suction wheel outer ring is brought into contact with the image carrier, and the suction wheel outer ring and cylindrical shaft being rotated in a same direction when air is sucked from the suction wheel.

5. An image forming apparatus comprising:

a latent image carrier that carries a latent image;

a development section that develops the latent image by means of liquid developer that forms an image on the latent image carrier;

an image carrier onto which the image that has been developed onto the latent image carrier by the development section is transferred;

a transfer roller that transfers the image that has been transferred onto the image carrier onto a transfer material; and a transfer material separation/suction section that sucks the transfer material onto which the image has been transferred and which is brought into contact with the image carrier so as to separate the transfer material from the image carrier, the transfer material separation/suction section including:

a suction wheel provided with a suction wheel outer ring having a cylindrical shaft with a suction port for sucking air and through holes; and a suction wheel removably contacting section that brings the suction wheel into contact with and separate from the image carrier, the suction wheel outer ring being provided so as to cover the cylindrical shaft and to be rotated independently of the cylindrical shaft, the suction port being disposed opposite to the transfer material when the suction wheel outer ring is brought into contact with the image carrier, and the suction wheel outer ring and cylindrical shaft being rotated in a same direction when air is sucked from the suction wheel.

* * * * *